US009833050B1

(12) United States Patent
Pellegrino

(10) Patent No.: US 9,833,050 B1
(45) Date of Patent: Dec. 5, 2017

(54) REVERSIBLE PROTECTIVE SLEEVE FOR ELECTRONIC DEVICE

(71) Applicant: Lucy Pellegrino, Massapequa, NY (US)

(72) Inventor: Lucy Pellegrino, Massapequa, NY (US)

( * ) Notice: Subject to any disclaimer, the term of this patent is extended or adjusted under 35 U.S.C. 154(b) by 73 days.

(21) Appl. No.: 15/086,005

(22) Filed: Mar. 30, 2016

Related U.S. Application Data

(60) Provisional application No. 62/153,254, filed on Apr. 27, 2015.

(51) Int. Cl.
*A45C 11/00* (2006.01)
*A45F 5/00* (2006.01)

(52) U.S. Cl.
CPC ..... *A45C 11/00* (2013.01); *A45F 5/00* (2013.01); *A45C 2011/002* (2013.01); *A45C 2011/003* (2013.01)

(58) Field of Classification Search
CPC ..... A45C 11/00; A45C 11/08; A45C 11/38; A45C 2011/002; A45C 2011/003; A45C 2011/001; A45C 7/0059; A45C 13/002; A45C 2001/086
USPC ..... 383/4, 38–43, 66, 84, 86, 87, 98, 99; 5/490–492; 150/103, 105, 112, 117, 133, 150/134, 147, 149, 152–154; 206/312, 206/313, 232
See application file for complete search history.

(56) References Cited

U.S. PATENT DOCUMENTS 1,469,080 A * 9/1923 Goerk ..... A24F 15/12 206/256
2,802,501 A * 8/1957 Stember ..... A45C 13/04 150/101
3,109,474 A * 11/1963 Levi ..... A47C 21/022 112/475.08
4,301,849 A 11/1981 Litwack et al.
5,101,974 A 4/1992 Alwitt
7,789,114 B2 9/2010 Pace et al.
2009/0114557 A1 5/2009 Nelson
2009/0293198 A1 12/2009 Fodge et al.
2010/0200129 A1 8/2010 Polozzolo et al.
2010/0224294 A1 9/2010 Svenson
2014/0263495 A1 9/2014 Koch

FOREIGN PATENT DOCUMENTS

CN 201468296 U 5/2010
JP 2012085689 A 5/2012

OTHER PUBLICATIONS

Anonymous, Reversible Dual Color Sleeve for Apple Ipad 2(blackred), website http://www.alibaba.com/cache/Reversible-Dual-Color-Neoprene-Sleeve-for_440268242.html, Feb. 13, 2015.

* cited by examiner

*Primary Examiner* — Jes F Pascua
*Assistant Examiner* — Nina Attel
(74) *Attorney, Agent, or Firm* — Werschulz Patent Law, LLC

(57) ABSTRACT

A protective reversible sleeve for an electronic device that provides a plurality of appearances. The sleeve has four members, each member having a flap and a panel with an opening between. The four panels form three compartments. The compartments can be turned inside out producing a different appearance every time the compartment is inverted, transforming the sleeve. The members are adjacent to each other, with the flap of one member opposite the panel of another member.

12 Claims, 8 Drawing Sheets

REVERSIBLE PROTECTIVE SLEEVE FOR ELECTRONIC DEVICE

CROSS-REFERENCE TO RELATED APPLICATIONS

This application is a nonprovisional utility application of the provisional patent application Ser. No. 62/153,254 filed in the United States Patent Office on Apr. 27, 2015 and claims the priority thereof and is expressly incorporated herein by reference in its entirety

TECHNICAL FIELD

The present disclosure relates generally to a sleeve for a portable electronic device. More particularly, the present disclosure relates to a protective multiply reversible sleeve for a portable electronic device.

BACKGROUND

People love their portable electronic devices. These devices, such as smart phones, tablets, E-readers and laptops, travel everywhere with their owners. However, these devices are also fragile. Most have screens that easily crack or shatter.

These devices are often dropped, banged and knocked about. Their very portability makes them vulnerable to damage during transport, especially since these devices are constant companions.

Most people place their devices in protective covers such as jackets or sleeves. From the very beginning, people wanted to make these protective jackets and sleeves into fashion accessories. From the very first "skin" for cellular phones, designers saw the potential to use the surface of these protective devices as a canvas for expression.

People quickly fell in love with their "skins" and covers and made multiple purchases, swapping the protective covers so that different designs displayed depending on the owner's mood, clothing ensemble or situation. These protective covers did not just protect the portable electronics but became fashion accessories.

Rather than purchase multiple covers, some people purchased covers that were reversible, giving the owner two choices to display. To increase the number of choices, people had to purchase multiple covers.

While these covers may be suitable for the particular purpose employed, or for general use, they would not be as suitable for the purposes and advantages of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF SUMMARY

An aspect of an example embodiment in the present disclosure is to provide a protective sleeve for electronic devices that is multiply reversible. Accordingly, an aspect of an example embodiment in the present disclosure provides a protective sleeve having a plurality of members, each having a different singular appearance that can be turned inside out to expose a surface with another different singular appearance.

Another aspect of an example embodiment in the present disclosure is to provide a protective sleeve that has a plurality of appearances. Accordingly, the present disclosure provides a sleeve having four members and three compartments that can continually be turned inside out, changing the appearance of the sleeve with each turn.

Accordingly, the present disclosure describes a protective multiply reversible sleeve for an electronic device that provides a plurality of appearances. The sleeve has four members, each member having a flap and a panel with an opening between. The four panels form three compartments. The compartments can be turned inside out producing a different appearance every time the compartment is inverted, transforming the sleeve. The members are adjacent to each other, with the flap of one member opposite the panel of another member.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
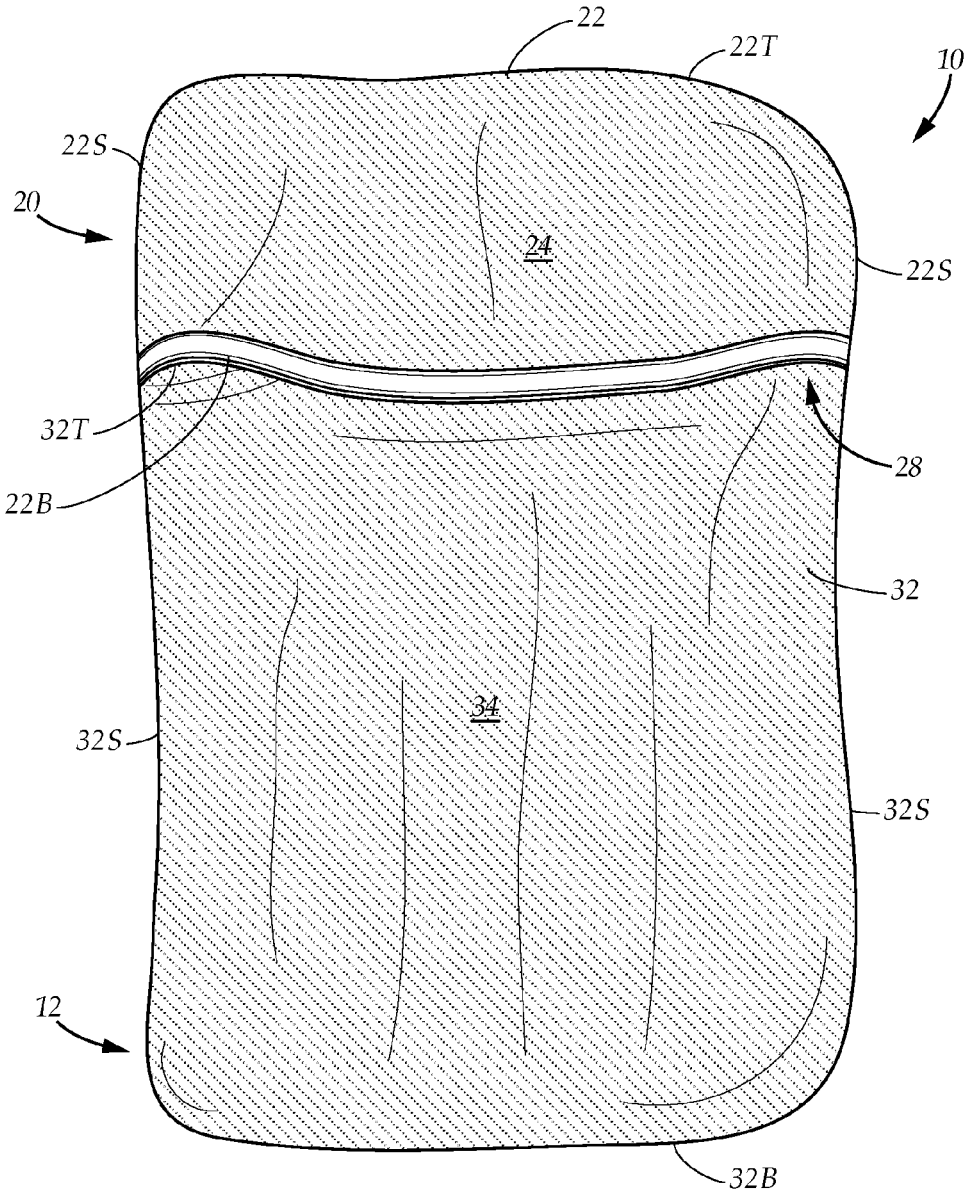
FIG. 1 is a perspective view of an example embodiment of a multiply reversible protective sleeve for an electronic device.

FIG. 1 illustrates a reversible protective sleeve 10 for an electronic device. The sleeve 10 is reversible, that is, an appearance of the sleeve 10 is reversibly changeable while maintaining the ability to protect the electronic device. Further, the sleeve is multiply reversible, transforming the appearance not just twice by a single inversion, but through multiple inversions.

The sleeve 10 accomplishes the change in appearance through a plurality of members that easily slip inside each other, exchanging positions within the sleeve and displaying different surface appearances on the sleeve exterior, transforming the appearance of the sleeve 10 with each exchange.

Shown is a first member 20 with a panel 32 and flap 22, the panel and flap overlapping an opening 28 towards the center of the opening. The panel 32 has a top 32T, a bottom 32B and a pair of sides 32S. The flap 22 has a top 22T, a bottom 22B and a pair of sides 22S. The first member 20 has a continuous edge formed by the panel bottom 32B, the panel sides 32S, the flap sides 22S and the flap top 22T. The panel and flap do not overlap at the flap sides 22S and panel sides 32S but only towards the center of the opening 28. The flap 22 can tuck behind the panel 32 or reversibly, the panel 32 can tuck behind the flap 22.

The other members are identically constructed, each with a continuous edge. The continuous edges of the members are bound together by a seam 12, coupling the members together as described hereinbelow. The seam can be formed by heat sealing, stitching, gluing, bias binding or other methods of seaming materials, the method of forming the seam not being a limitation.

In the illustration, the flap 22 of the first member 20 has a first surface 24 with a first singular associated appearance and the panel 32 of the first member 20 has a first surface 34 with a second singular associated appearance. In the illustration, the two surfaces have the same singular appearance. This should not be construed as a limitation.

The surfaces of each member of the sleeve and of each flap and each panel comprising one member can have a singular associated appearance, each one different, but also the panels and flaps can have surfaces with matching appearances within each member or some combination thereof.

Each flap as described below has a pair of opposing surfaces back to back, each surface capable of presenting its own singular associated appearance and each panel has a pair of opposing surfaces back to back, each surface capable its own singular associated appearance. Both surfaces of the flap may have the same associated appearance and both surfaces of the panel may have the same associated appearance.

It is understood that each flap having two surfaces and each panel having each surfaces is capable of matching the surfaces of other flaps, other flap surfaces other panels and other panel surfaces. In the embodiment that uses nonwoven materials, the two surfaces of each flap may have the same appearance and the two surfaces of each panel may have the same appearance.

In one example embodiment, the members are constructed from neoprene and laminated with nylon/spandex, the nylon/spandex capable of infinite variations in appearance such as solid colors and limitless patterns. Other materials that have the same resiliency and stretch as these materials are envisioned as part of the inventive concept.

In another example embodiment, the neoprene members have colors and dyes added directly to polymer, creating members that have the same appearance on both back to back surfaces. Other similar materials such as other polyester-polyurethane copolymer that have sufficient stretch and resiliency as neoprene are envisioned as part of the inventive concept.

Figure 2:
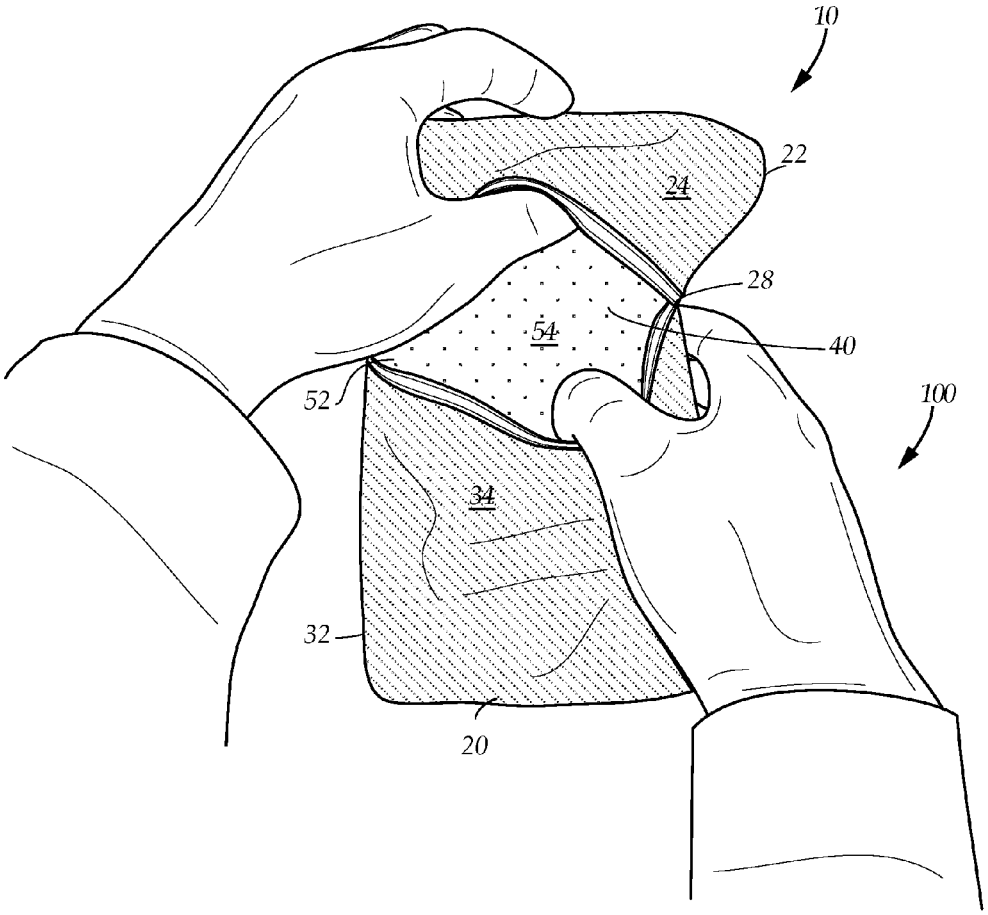
FIG. 2 is a perspective view of the example embodiment of the reversible protective sleeve for an electronic device beginning an inversion process.
Figure 3:
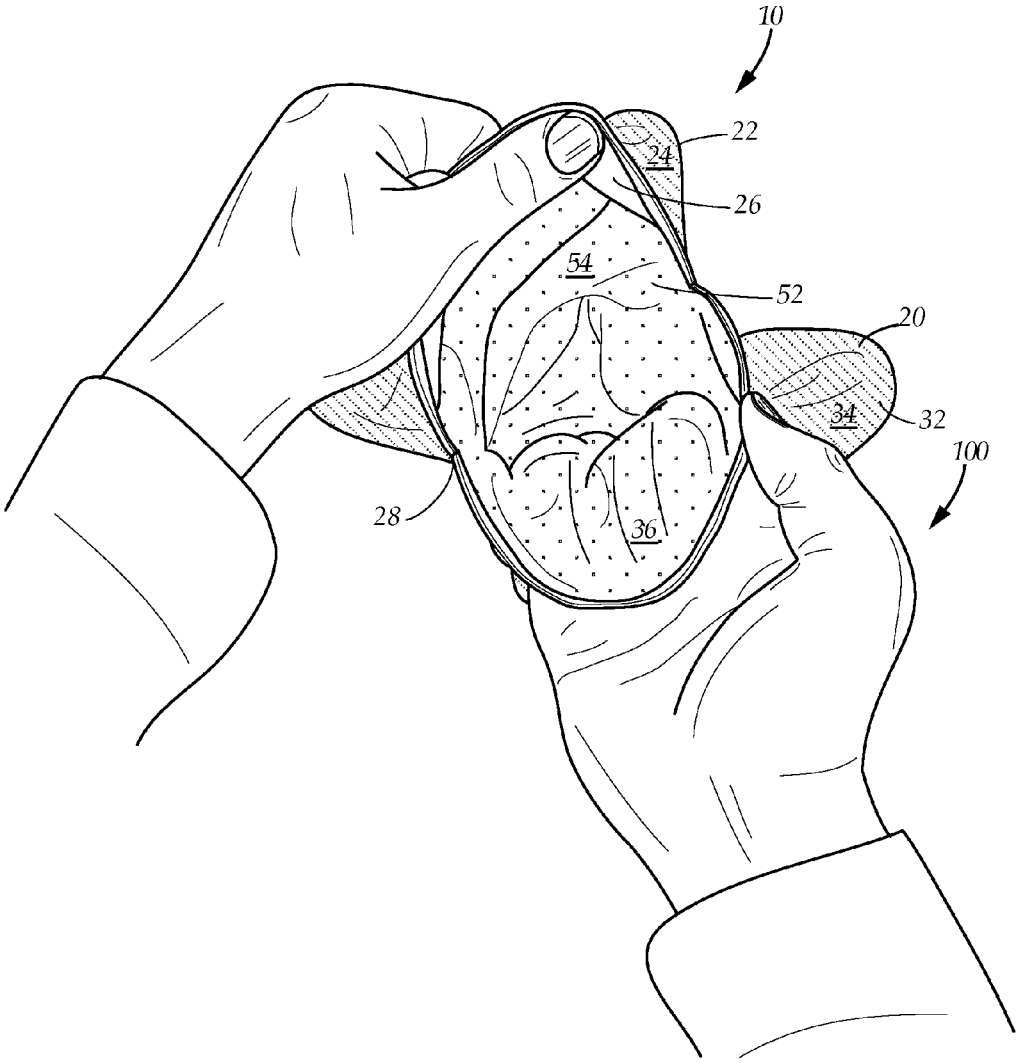
FIG. 3 is a perspective view of the example embodiment of the reversible protective sleeve for an electronic device in the inversion process.
Figure 4:
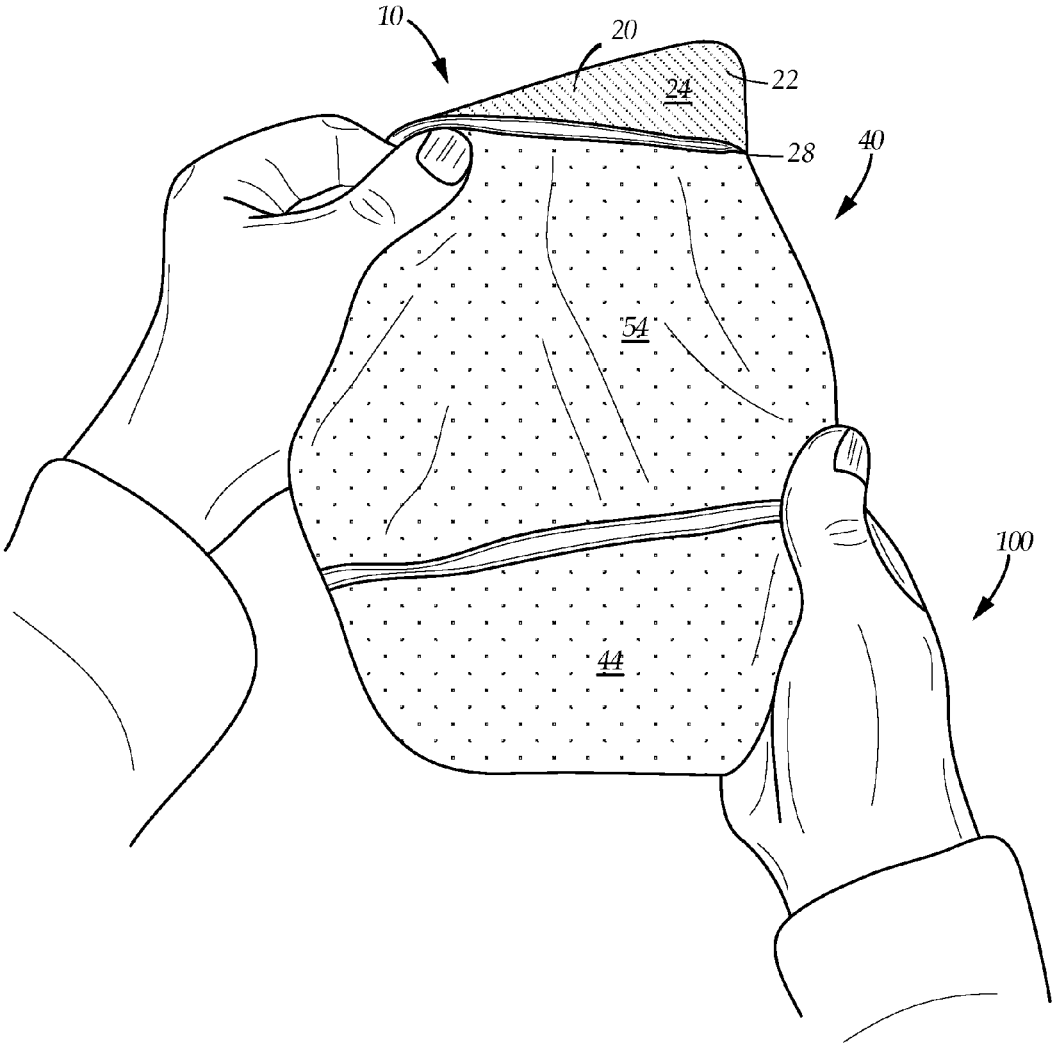
FIG. 4 is a perspective view of the example embodiment of the reversible protective sleeve for an electronic device ending the inversion process.

FIG. 2 through FIG. 4 show a user 100 transforming the sleeve 10. A second member 40 is pulled through the opening 28 of the first member 20 and folded over the sleeve 10, providing a singular appearance to the sleeve by displaying an associated appearance of a first surface 54 of the panel 52 of the second member 40 and an associated appearance of a first surface 44 of the flap 42, the second member, forming a first outer compartment and further displaying an associated appearance of a second surface 36 of the panel of the first member 20 and an associated appearance of a second surface 26 of the flap 22 the first member forming a second outer compartment.

Figure 5:
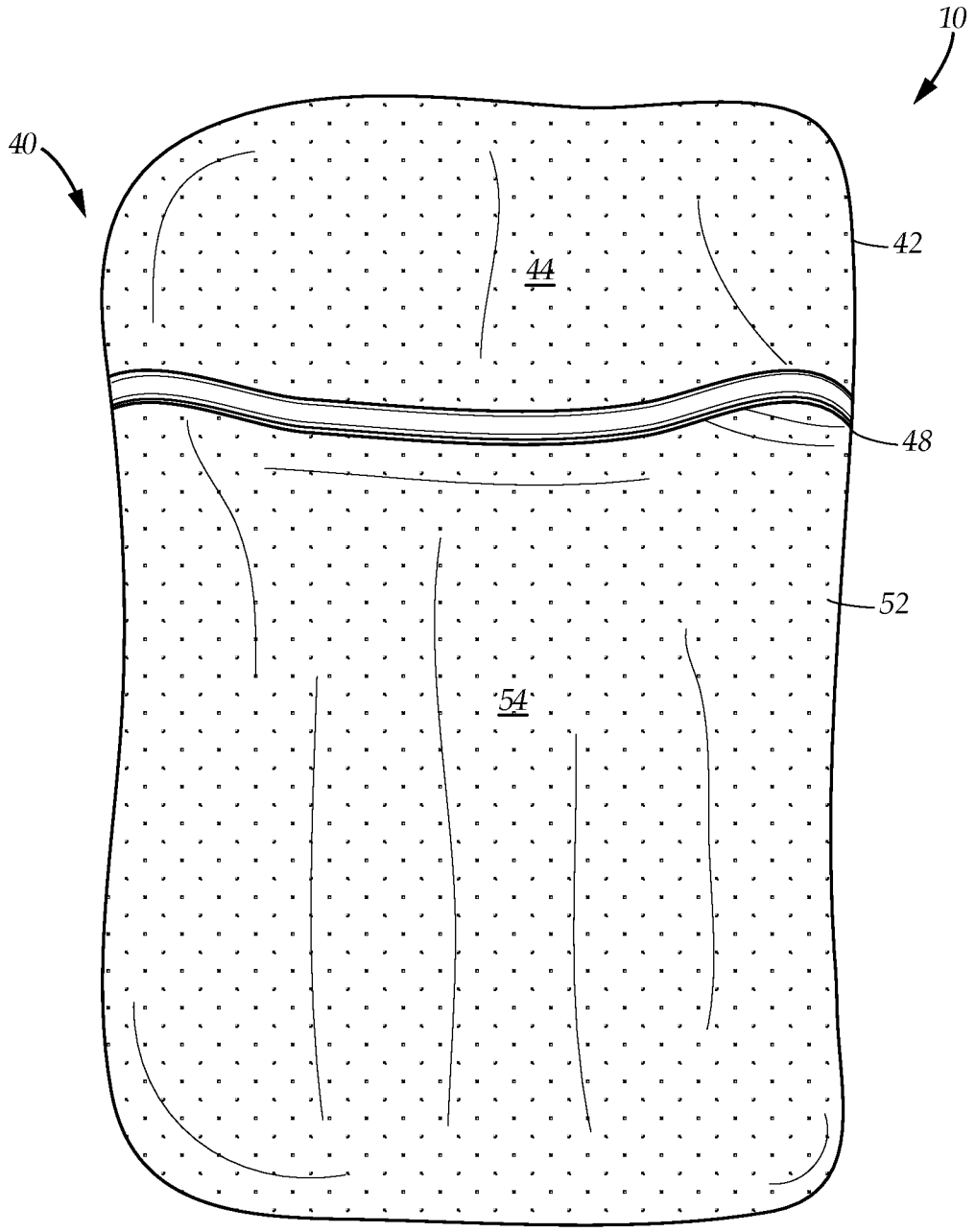
FIG. 5 is a perspective view of the example embodiment of the reversible protective sleeve for an electronic device showing a new surface appearance.

FIG. 5 shows the transformed sleeve 10 with a first surface 44 of the flap 42 of the second member 40 and the first surface 54 of the panel 52 of the second member 40 forming an opening 48. One of ordinary skill understands that this transformation can be continued as described hereinbelow, the sleeve 10 having an even number of members.

The following transformations are not shown in separate illustrations, but FIGS. 2 through 4 show the process that is repeated. With each repetition, the sleeve 10 changes in appearance. The third member is pulled through the opening of the second member and folded over the sleeve, providing an singular appearance to the sleeve by displaying an associated appearance of a first surface of the panel of the third member and an associated appearance of a first surface of the flap of the third member, forming a first outer compartment and further displaying an associated appearance of a second surface of the panel of the second member and an associated appearance of a second surface of the flap of the second member forming a second outer compartment opposite the first.

The fourth member is pulled through the opening of the third member and folded over the sleeve 10, providing a singular appearance to the sleeve by displaying an associated appearance of a first surface of the panel of the fourth member and an associated appearance of a first surface of the flap of the fourth member, forming a first outer compartment and further displaying an associated appearance of a second surface of the panel of the third member and an associated appearance of a second surface of the third member forming a second outer compartment.

The first member is pulled through the opening of the fourth member and folded over the sleeve 10, providing an original singular appearance to the sleeve by displaying an associated appearance of a first surface of the panel of the first member and an associated appearance of a first surface of the flap of the first member, forming a first outer compartment and further displaying an associated appearance of a second surface of the panel of the fourth member and an associated appearance of a second surface of the fourth member forming a second outer compartment, the sleeve returning to the original singular appearance as shown in FIG. 1

Figure 6:
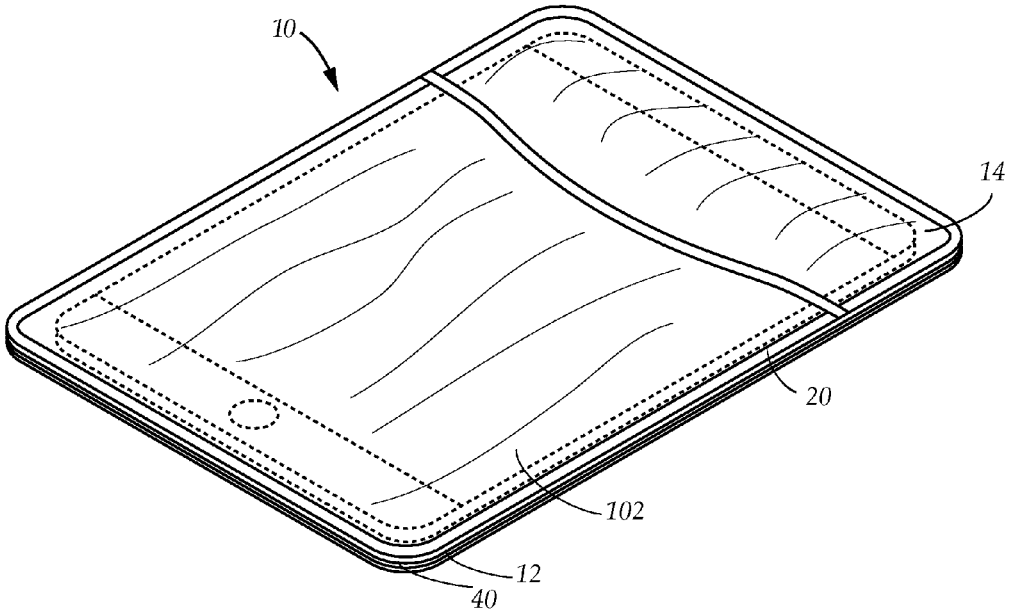
FIG. 6 is a perspective view of the example embodiment of the reversible protective sleeve for an electronic device showing an electronic device therein.

FIG. 6 shows an electronic device 102 inside the sleeve 10, the seam 12 joining the members together, the electronic device sitting in a first outer compartment 14 formed by the joined members 20, 40.

Figure 8:
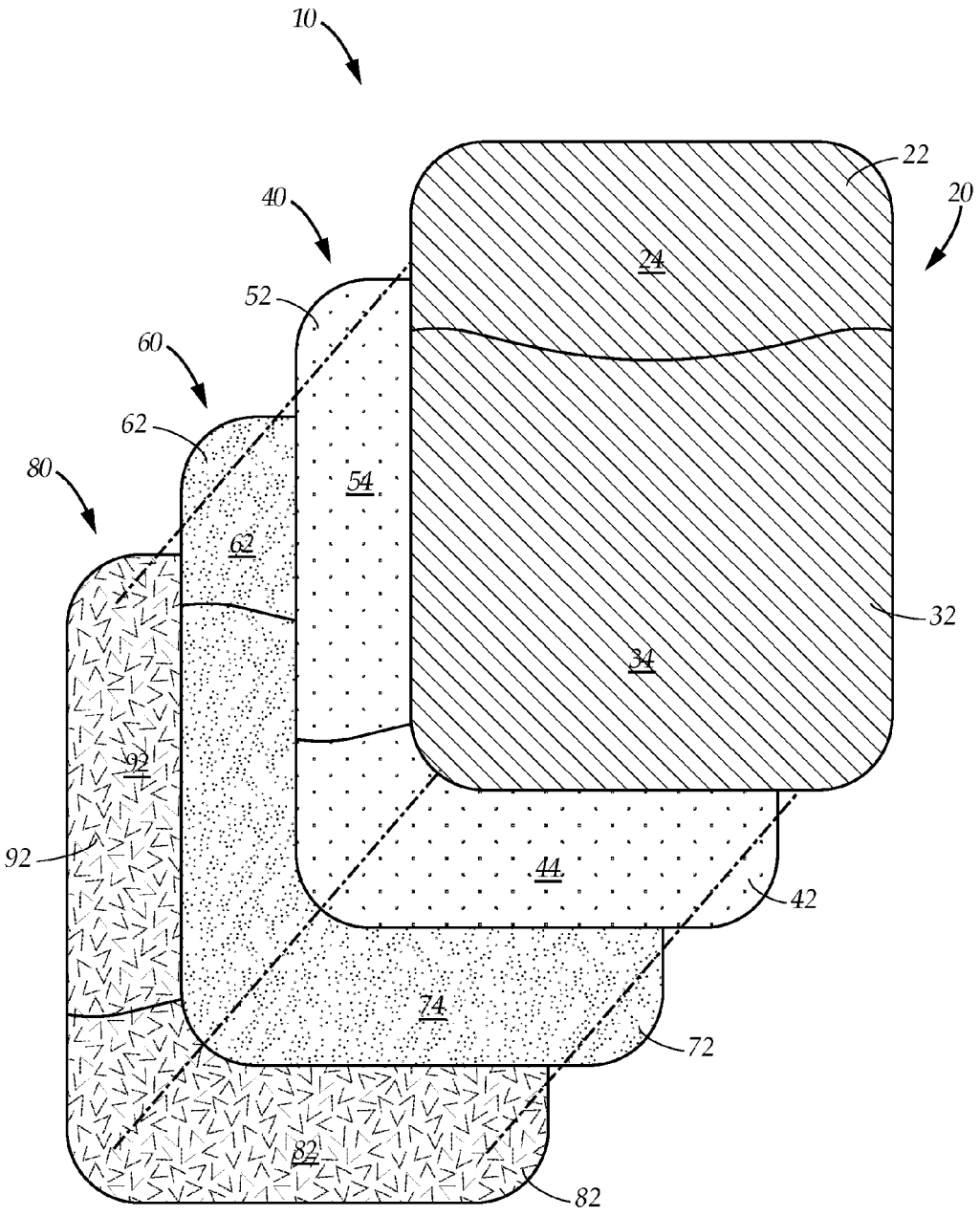
FIG. 8 is an exploded view of a plurality of members comprising the example embodiment of the reversible sleeve.

FIG. 8 shows the construction of an example embodiment of the sleeve 10 having at least four members. The sleeve 10 has the first member 20, the second member 40, the third member 60, and the fourth member 80. The first member 20 has the flap 22 showing the first surface 24 and the panel 32 showing the first surface 34.

The second member 40 has the flap 42 showing the first surface 44 and the panel 52 showing the first surface 54.

The third member 60 has the flap 62 showing the first surface 64 and the panel 72 showing the first surface 74.

The fourth member 80 has the flap 82 showing the first surface 84 and the panel 92 showing the first surface 94.

To construct the sleeve, the second member 40 is placed adjacent to the first member 20, the first surface 44 of the second member flap 40 is opposite the second surface (not visible) of the first member panel 32 and the first surface 54 of the second member panel 52 is opposite the second surface (not visible) of the first member flap 24.

The third member 60 is placed adjacent to the second member 40, the first surface 64 of the third member flap 60 is opposite the second surface (not visible) of the second member panel 52 and the first surface 74 of the third member panel 72 is opposite the second surface (not visible) of the second member flap 44.

The fourth member 80 is placed adjacent to the third member 60, the first surface 84 of the fourth member flap 80 is opposite the second surface (not visible) of the third member panel 72 and the first surface 94 of the fourth member panel 92 is opposite the second surface (not visible) of the third member flap 64.

The continuous edges of the members as described hereinabove are bound together by a seam 12, coupling the members together.

Described and shown was the reversible sleeve having at least four members, but a greater even number of members is possible within the inventive concept.

Figure 7:
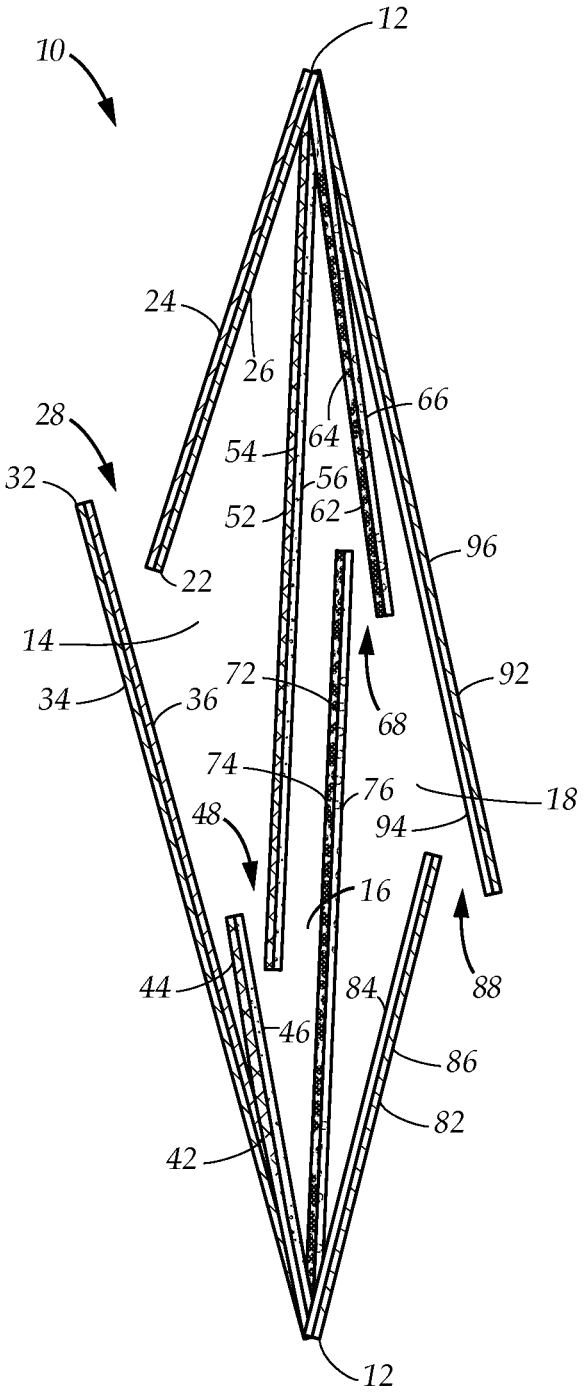
FIG. 7 is a side elevational view of the example embodiment of the reversible sleeve cut along a center longitudinal axis.

FIG. 7 shows a cross-section down the center long axis of the sleeve 10, showing how the four members form three compartments, two outer compartments 14, 18 and an inner compartment 16 that is concealed. Starting from the left side of the drawing, the first flap 22 has two surfaces, the first surface 24 and the second surface 28. The panel has two surfaces, the first surface 34 and the second surface 36. Between the flap 22 and panel 32 is the opening 28.

The second panel 52 is opposite the first flap 22 and the second flap 44 is opposite the first panel 32, forming an outer first compartment 14. The second panel 52 has two surfaces, the first surface 54 and the second surface 56 and the second flap 42 has two surfaces, the first surface 44 and the second surface 46. There is an opening 48 between the second flap 42 and the second panel 52.

The third panel 72 is opposite the second flap 42 and the third flap 64 is opposite the second panel 52, forming an inner second compartment 16. The third panel 72 has two surfaces, the first surface 74 and the second surface 76 and the third flap 62 has two surfaces, the first surface 64 and the second surface 66. There is an opening 68 between the third flap 62 and the third panel 72.

The fourth panel 92 is opposite the third flap 62 and the fourth flap 84 is opposite the second panel 72, forming an outer third compartment 18. The fourth panel 92 has two surfaces, the first surface 94 and the second surface 96 and the fourth flap 82 has two surfaces, the first surface 84 and the second surface 86. There is an opening 88 between the fourth flap 62 and the fourth panel 72.

The appearance of the sleeve 10 changes every time one of the outer compartments is turned inside out, but three compartments are always available to be used for storing an electronic device or article, the inner compartment 16 generally concealed.

All three compartments are useful for protecting an electronic device. Three similarly sized electronic devices could be stored, one in each separate compartment. The size of the sleeve is adjustable to fit a wide variety of electronic devices from smart phones, tablets, "phablets" and laptops.

It is further understood that the structure of the multiply reversible sleeve as shown in FIGS. 7 and 8 can be made from many different types of pliant materials and fabrics and can used in other contexts, such as for pillow shams, pillow cases, duvet covers, placemats and similar bedding articles and furniture accessories. The multiply reversible sleeve functions in the same manner with the same structure regardless of the articles that are within the sleeve that are being covered or protected. Size and intended purpose are not limitations of the multiply reversible sleeve.

It is further understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a multiply reversible protective sleeve for electronic devices. The disclosure is illustrated by example in the drawing figures, and throughout the written description. It should be understood that numerous variations are possible, while adhering to the inventive concept. Such variations are contemplated as being a part of the present disclosure.

What is claimed is:

1. A reversible protective sleeve for an electronic device, comprising:

four members, each of the four members having a panel with a top, a bottom, and a pair of sides, each of the four members having a flap with a top, a bottom and a pair of sides, the top of the panel and bottom of the flap overlapping, forming an opening, each of the four members having a continuous edge formed by the bottom and the sides of the panel and the top and the sides of the flap; and a seam joining the continuous edges of the four members, the bottom and the sides of the panel of the four members joining the edges of the top and the sides of the flap of a second member of the four members such that the opening of the second member is transposed away from the opening of the first member.

2. The reversible protective sleeve for an electronic device as described in claim 1, wherein the sleeve has three compartments, two outer compartments and an inner compartment formed by the four members.

3. The reversible protective sleeve for an electronic device as described in claim 1, wherein the second member is pulled through the opening of the first member, the first member is folded over a rear face of the sleeve, such that the second member provides a singular appearance to a front face of the sleeve by displaying an associated appearance of a first surface of the panel of the second member and an associated appearance of a first surface of the flap of the second member, such that a first outer compartment is defined between the second member and a third member of the four members, such that the first member provides an appearance to the rear face of the sleeve by displaying an associated appearance of a second surface of the panel of the first member and an associated appearance of a second surface of the flap of the first member, and such that a second outer compartment is formed between the first member and a fourth member of the four members.

4. The reversible protective sleeve for an electronic device as described in claim 3, wherein the third member is pulled through the opening of the second member, the second member is folded over the rear face of the sleeve, such that the third member provides a singular appearance to the front face of the sleeve by displaying an associated appearance of a first surface of the panel of the third member and an associated appearance of a first surface of the flap of the third member, such that the first outer compartment is defined between the third member and the fourth member, such that the second member provides an appearance to the rear face of the sleeve by displaying an associated appearance of a second surface of the panel of the second member and an associated appearance of a second surface of the flap of the second member, and such that the second outer compartment is formed between the second member and the first member.

5. The reversible protective sleeve for an electronic device as described in claim 4, wherein the fourth member is pulled through the opening of the third member, the third member is folded over the rear face of the sleeve, such that the fourth member provides a singular appearance to the front face of the sleeve by displaying an associated appearance of a first surface of the panel of the fourth member and an associated appearance of a first surface of the flap of fourth member, such that the first outer compartment is defined between the fourth member and the first member, such that the third member provides an appearance to the rear face of the sleeve by displaying an associated appearance of a second surface of the panel of the third member and an associated appearance of a second surface of the flap of the third member, and such that the second outer compartment is formed between the third member and the second member.

6. The reversible protective sleeve for an electronic device as described in claim 5, wherein the first member is pulled through the opening of the fourth member, the fourth member is folded over the rear face of the sleeve, such that the first member provides a singular appearance to the front face of the sleeve by displaying an associated appearance of a first surface of the panel of the first member and an associated appearance of a first surface of the flap of the first member, such that the first outer compartment is defined between the first member and the second member, such that the fourth member provides an appearance to the rear face of the sleeve by displaying an associated appearance of a second surface of the panel of the fourth member and an associated appearance of a second surface of the flap of the fourth member, and such that the second outer compartment is formed between the fourth member and the third member.

7. A reversible protective sleeve for an electronic device, comprising:

four members joined by a seam, each of the four members having a panel with a top, a bottom, and a pair of sides, each of the four members having a flap with a top, a bottom and a pair of sides, the top of the panel and bottom of the flap overlapping, forming an opening, each member having a continuous edge formed by the bottom and the sides of the panel and the top and the sides of the flap, the bottom and the sides of the panel of of the four members joining the edges of the top and the sides of the flap of a second member of the four members such that the opening of the second member is transposed away from the opening of the first member configured so that the first member easily slips inside the second member, exchanging positions of the members within the sleeve.

8. The reversible protective sleeve for an electronic device as described in claim 7, wherein the sleeve has three compartments, two outer compartments and an inner compartment.

9. A method of using a reversible protective sleeve for an electronic device, comprising:

pulling a second member of the sleeve through an opening of a first member, the opening formed by a panel and a flap of the first member the first member folding over a rear face of the sleeve such that the second member provides a singular appearance to a front face of the sleeve by displaying an associated appearance of a first surface of a panel of the second member and an associated appearance of a first surface of a flap of a second member, such that a first outer compartment is defined between the second member and a third member, such that the first member provides an appearance to the rear face of the sleeve by displaying an associated appearance of a second surface of the panel of the first member and an associated appearance of a second surface of the flap of the first member, such that a second outer compartment is formed between the first member and a fourth member, and such that a third inner compartment is formed between the first outer compartment and the second outer compartment.

10. The method as described in claim 9, wherein the steps of pulling the second member through the opening of the first member is followed by the steps of:

pulling the third member of the sleeve through an opening of the second member, folding the second member over the rear face of the sleeve such that the third member provides a singular appearance to the front face of the sleeve by displaying an associated appearance of a first surface of a panel of the third member and an associated appearance of a first surface of a flap of the third member, such that the first outer compartment is defined between the third member and the fourth member, such that the second member provides an appearance to the rear face of the sleeve by displaying an associated appearance of a second surface of the panel of the second member and an associated appearance of a second surface of the flap of the second member and such that the second outer compartment is formed between the second member and the first member.

11. The method as described in claim 10, wherein the steps of pulling the third member through the opening of the second member is followed by the steps of:

pulling the fourth member of the sleeve through an opening of the third member, the third member folding over the rear face of the sleeve, such that the fourth member provides a singular appearance to the front face of the sleeve by displaying an associated appearance of a first surface of a panel of the fourth member and an associated appearance of a first surface of a flap of the fourth member, such that the first outer compartment is defined between the fourth member and the first member, such that the third member provides an appearance to the rear face of the sleeve by displaying an associated appearance of a second surface of the panel of the third member and an associated appearance of a second surface of the flap of the third member, such that the second outer compartment is formed between the third member and the second member.

12. The method as described in claim 11, wherein the steps of pulling the fourth member through the opening of the third member is followed by the steps of:

pulling the first member through the opening of the fourth member folding the fourth member over the rear face of the sleeve, such that the first member provides a singular appearance to the front face of the sleeve by displaying an associated appearance of a first surface of the panel of the first member and an associated appearance of a first surface of the flap of the first member, such that the first outer compartment is defined between the first member and the second member, such that the fourth member provides an appearance to the rear face of the sleeve by displaying an associated appearance of a second surface of the panel of the fourth member and an associated appearance of a second surface of the flap of the fourth member, and such that the second outer compartment is formed between the fourth member and the third member.

* * * * *